US007634213B2

(12) United States Patent
Yoshida et al.

(10) Patent No.: US 7,634,213 B2
(45) Date of Patent: Dec. 15, 2009

(54) TONER COLLECTING DEVICE, IMAGE FORMING UNIT AND IMAGE FORMING APPARATUS

(75) Inventors: Tomofumi Yoshida, Tokyo (JP); Yoshiyuki Shimizu, Ohsaka (JP); Kenzo Tatsumi, Ohsaka (JP); Hirobumi Ooyoshi, Tokyo (JP); Shintaro Yamada, Tokyo (JP)

(73) Assignee: Ricoh Company, Ltd., Tokyo (JP)

( * ) Notice: Subject to any disclaimer, the term of this patent is extended or adjusted under 35 U.S.C. 154(b) by 384 days.

(21) Appl. No.: 11/554,833

(22) Filed: Oct. 31, 2006

(65) Prior Publication Data

US 2007/0104523 A1 May 10, 2007

(30) Foreign Application Priority Data

Nov. 4, 2005 (JP) ..... 2005-320698

(51) Int. Cl.
*G03G 15/08* (2006.01)
*G03G 21/00* (2006.01)

(52) U.S. Cl. ..... 399/120; 399/358

(58) Field of Classification Search ..... 399/120, 399/358, 359, 360

See application file for complete search history.

(56) References Cited

U.S. PATENT DOCUMENTS 5,848,342 A * 12/1998 Tanda ..... 399/358
5,887,224 A * 3/1999 Mizuishi et al. ..... 399/359 X
6,711,366 B2 * 3/2004 Beaufort ..... 399/120
6,904,249 B2 * 6/2005 Kato et al. ..... 399/120
2005/0008962 A1 * 1/2005 Katoh et al. ..... 430/108.6
2008/0199234 A1 8/2008 Hagi et al.

FOREIGN PATENT DOCUMENTS

JP 3281595 2/2002

OTHER PUBLICATIONS

U.S. Appl. No. 11/870,104, filed Oct. 10, 2007, Shimizu, et al.
U.S. Appl. No. 11/870,136, filed Oct. 10, 2007, Tatsumi, et al.
U.S. Appl. No. 11/947,369, filed Nov. 29, 2007, Inoue, et al.
U.S. Appl. No. 11/951,584, filed Dec. 6, 2007, Yoshida, et al.
U.S. Appl. No. 11/949,339, filed Dec. 3, 2007, Tatsumi, et al.

(Continued)

*Primary Examiner*—Sandra L Brase
(74) *Attorney, Agent, or Firm*—Oblon, Spivak, McClelland, Maier & Neustadt, L.L.P.

(57) ABSTRACT

In a toner collecting device of the present invention for conveying collected waste toner to a waste toner storing portion with a toner conveying device, the toner conveying device is positioned at a side opposite to a driveline included in an apparatus body to which the toner collecting device is mounted. A driveline for driving the toner conveying device is not arranged at the side opposite to the driveline of the apparatus body, but the toner conveying device is directly driven by the driveline of the apparatus body. With this configuration, the toner collecting device is capable of driving, e.g., a toner conveying belt or a toner conveying screw arranged at the counter drive side without sophisticating the configuration.

7 Claims, 5 Drawing Sheets

OTHER PUBLICATIONS

U.S. Appl. No. 11/967,635, filed Dec. 31, 2007, Shimizu, et al.
U.S. Appl. No. 11/965,198, filed Dec. 27, 2007, Murayama, et al.
U.S. Appl. No. 12/020,915, filed Jan. 28, 2008, Kubota, et al.
U.S. Appl. No. 12/042,850, filed Mar. 5, 2008, Shimizu, et al.
U.S. Appl. No. 12/103,941, filed Apr. 16, 2008, Shimizu.
U.S. Appl. No. 12/117,895, filed May 9, 2008, Tatsumi, et al.
U.S. Appl. No. 12/170,842, filed Jul. 10, 2008, Kubota, et al.
U.S. Appl. No. 12/179,038, filed Jul. 24, 2008, Murayama, et al.

* cited by examiner

TONER COLLECTING DEVICE, IMAGE FORMING UNIT AND IMAGE FORMING APPARATUS

BACKGROUND OF THE INVENTION

1. Field of the Invention

The present invention relates to a copier, printer, facsimile apparatus or similar image forming apparatus and a toner collecting device arranged in an image forming unit included in the image forming apparatus and more particularly to a toner collecting device including toner conveying means for conveying collected waste toner to a waste toner storing portion.

2. Description of the Background Art

It is a common practice with a copier, printer, facsimile apparatus or similar image forming apparatus to uniformly charge the surface of an image carrier implemented as a photoconductive body, expose the charged surface of the image carrier imagewise to form a latent image, deposit toner or similar fine particles on the latent image with a developing unit for forming a corresponding toner image, transfer the toner image from the image carrier to a recording medium either directly or via an intermediate image transfer body, and then fix the toner image on the recording medium for thereby producing a print. The prerequisite with such an image forming apparatus is to remove toner left on the image carrier without being transferred to the recording medium due to the potential distribution balance, fog or forced stop of the apparatus to thereby clean the surface of the image carrier.

Modern image forming apparatuses include one of the type including a mechanism for collecting the toner removed from the surface of the image carrier (referred to as waste toner hereinafter) and storing it in, e.g., a collecting portion included in an image forming unit or returning it to a developing device for reuse.

Japanese Patent No. 3,281,595, for example, discloses an electrophotographic recording apparatus including a toner conveying belt mounted on one side of a process cartridge and configured to convey toner collected from the surface of a photoconductive drum to a developing section via a toner collecting chamber. This document describes in paragraph [0016] that the toner conveying belt is driven by a pulley which is also mounted on one side of the process cartridge, as shown in FIG. 1 of Japanese Patent No. 3,281,595.

In the above paragraph [0016] of the same document, there is simply described that the pulley is rotated by a drive source, not shown, in a direction indicated by an arrow. However, it has been customary with an image forming apparatus to arranged a driveline for driving a photoconductive drum or the like (referred to as a body driveline hereinafter) at one side of the apparatus body and arrange a toner conveying belt or a toner conveying screw and so forth for the collection of waste toner at the other side (referred to as a counter drive side hereinafter) and drive it by driving a pulley or a gear, which is mounted on one side of a process cartridge or an image forming unit, with a shaft extending from the body driveline. Such a configuration facilitates the layout of the toner conveying belt or the toner conveying screw and pulleys and gears for driving it.

However, a gear train or similar drive transmission mechanism arranged at the counter drive side for driving a toner conveying belt or the toner conveying screw is undesirable because it increase the number of parts, increases the number of assembling steps while sophisticating the assembly, causes drive transmission losses to accumulate, and increase required torque and therefore aggravates power consumption, thereby increasing the overall cost of the apparatus. Moreover, because the gear train, for example, needs an exclusive space at the counter drive side, the width of the process cartridge or that of the image forming unit and therefore the overall size of the apparatus increases.

SUMMARY OF THE INVENTION

It is an object of the present invention to provide a waste toner collecting device, an image forming unit and an image forming apparatus capable of driving, e.g., a toner conveying belt or a toner conveying screw arranged at the counter drive side without sophisticating the configuration.

In a toner collecting device of the present invention for conveying collected waste toner to a waste toner storing portion with a toner conveying device, the toner conveying device is positioned at a side opposite to a driveline included in an apparatus body to which the toner collecting device is mounted. A driveline for driving the toner conveying device is not arranged at the side opposite to the driveline of the apparatus body, but the toner conveying device is directly driven by the driveline of the apparatus body.

An image forming unit of the present invention includes an image carrier, a cleaning device for removing toner left on the image carrier, and a toner collecting device configured to convey waste toner thus removed from the image carrier to a waste toner storing portion with a toner conveying device for thereby collecting the waste toner. The toner conveying device is positioned at a side opposite to a driveline included in an apparatus body to which the toner collecting device is mounted. A driveline for driving the toner conveying device is not arranged at the side opposite to the driveline of the apparatus body, but the toner conveying device is directly driven by the driveline of the apparatus body.

Further, an image forming apparatus of the present invention includes an image forming unit including an image carrier and a cleaning device configured to remove toner left on the image carrier, and a toner collecting device configured to convey waste toner thus removed from the image carrier to a waste toner storing portion with a toner conveying device for thereby collecting the waste toner. The toner conveying device is positioned at a side opposite to a driveline included in an apparatus body to which the toner collecting device is mounted. A driveline for driving the toner conveying device is not arranged at the side opposite to the driveline of the apparatus body, but the toner conveying device is directly driven by the driveline of the apparatus body.

BRIEF DESCRIPTION OF THE DRAWINGS

The above and other objects, features and advantages of the present invention will become more apparent from the following detailed description taken with the accompanying drawings in which.

DESCRIPTION OF THE PREFERRED EMBODIMENT

Figure 1:
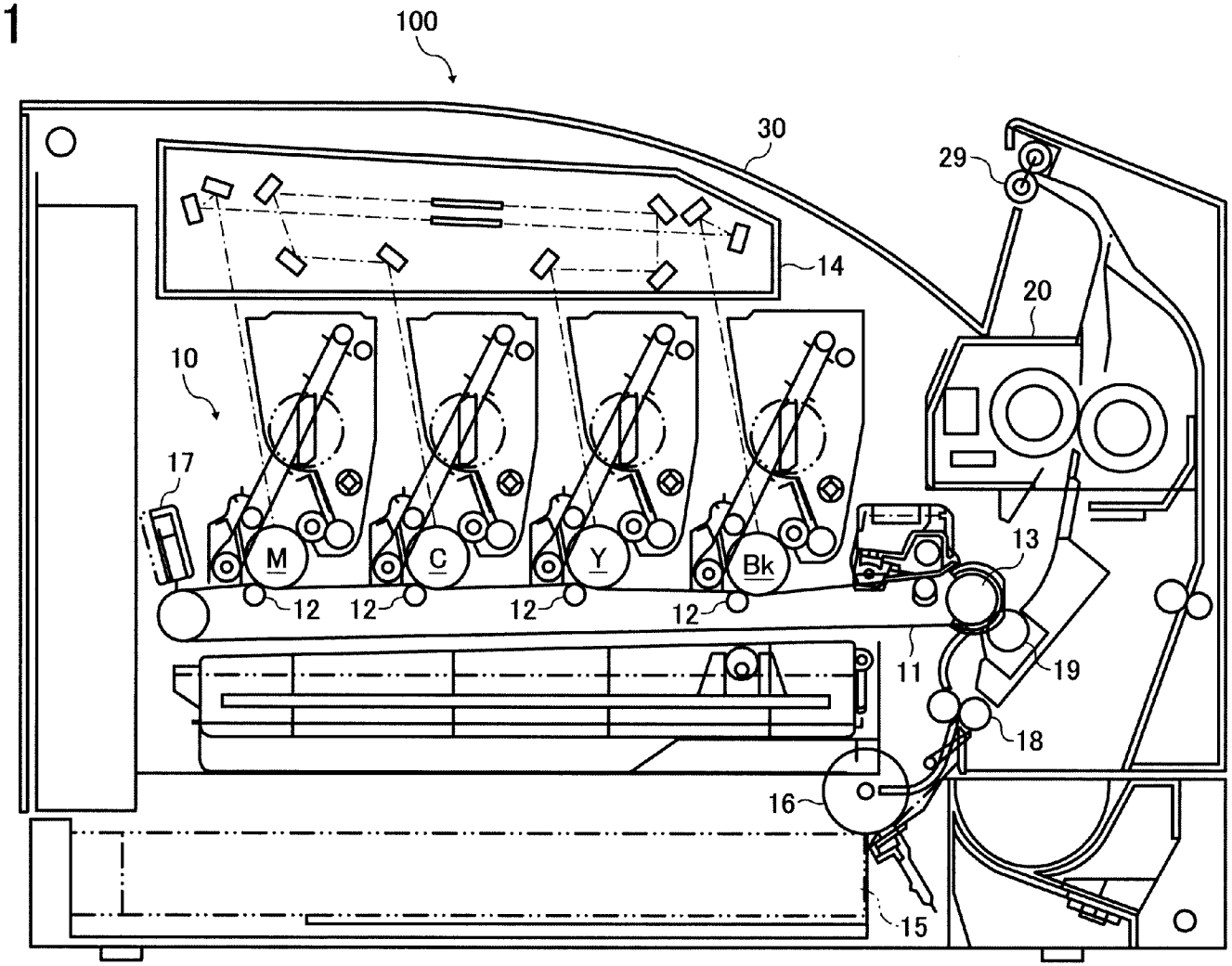
FIG. 1 is a section showing an image forming apparatus embodying the present invention.

Referring to FIG. 1 of the drawings, an image forming apparatus embodying the present invention is shown and implemented as a full-color printer by way of example. As shown, the full-color printer (simply printer hereinafter), generally 100, includes an intermediate image transfer belt 11 positioned at substantially the center of the printer body and passed over a plurality of rollers. Four image forming units 10M (magenta), 10C (cyan), 10Y (yellow) and 10Bk (black) are arranged side by side along the upper run of the intermediate image transfer belt 11.

Figure 2:
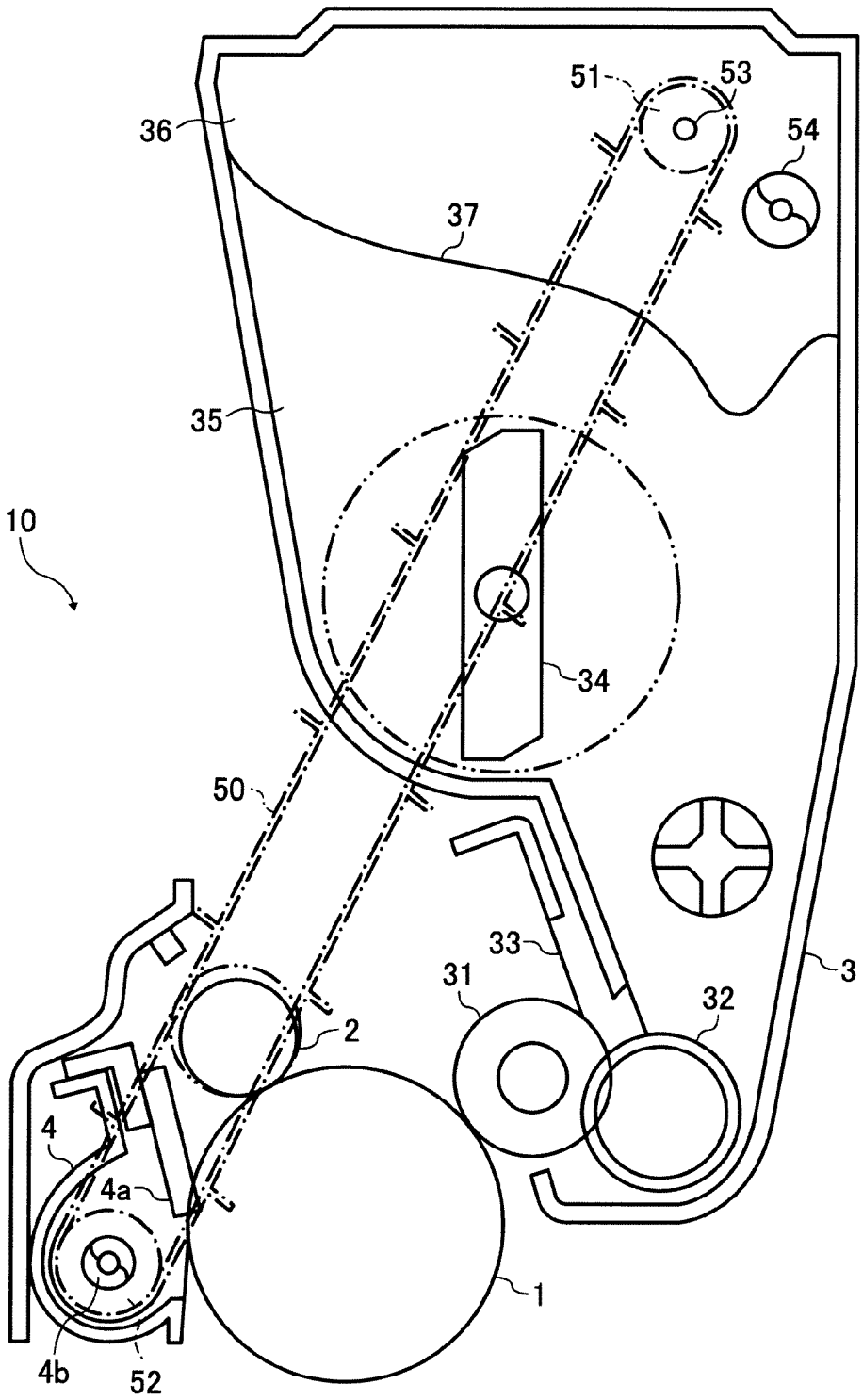
FIG. 2 is a vertical section showing an image forming unit included in the illustrative embodiment.

FIG. 2 shows one of the image forming units 10M, 10C, 10Y and 10Bk in detail. As shown, the image forming unit, labeled 10, includes a photoconductive drum 1, which is a specific form of an image carrier. A charger 2, a developing device 3, a cleaning device 4 and so forth are arranged around the drum 1. Further, an image transfer roller or primary image transferring means 12, see FIG. 1, is positioned at the inside of the intermediate image transfer belt 11 in such a manner as to face the drum 1.

As shown in FIG. 1, while the image forming units 10M, 10C, 10Y and 10Bk included in the illustrative embodiment are provided with the same structure as each other, they are different from each other as to the color of toner which the developing unit deals with. In the illustrative embodiment, the image forming units 10M, 10C, 10Y and 10Bk, dealing with magenta toner, cyan toner, yellow toner and black toner, respectively, are sequentially arranged from the left to the right, as viewed in FIG. 1, in this order. Each image forming unit 10 is implemented as a process cartridge removably mounted to the printer body.

An optical writing unit 14 is positioned above the image forming units 10M through 10Bk and includes a polygonal mirror, groups of mirrors and so forth although not shown specifically. The optical writing unit 14 is configured to scan the surface of the drum of each image forming unit with a laser beam modulated in accordance with image data of particular color.

A sheet cassette 15 is positioned in the lower portion of the printer body and provided with sheet feeding means 16, which is configured to pay out paper sheets or similar recording media (referred to sheets hereinafter) stacked on the sheet cassette 15 one by one. A registration roller pair 18 is located obliquely above the sheet feeding means 15, i.e., downstream of the sheet feeding means 15 in the direction of sheet conveyance. An image transfer roller or secondary image transferring means 19 is positioned above the registration roller pair 18 while facing a roller 13, which is one of the rollers over which the intermediate image transfer belt 11 is passed, constituting a secondary image transfer section.

A fixing unit 20 is positioned above the secondary image transfer section. The top of the printer body is implemented as a print tray 30 while an outlet roller pair 29 is positioned above the fixing unit 20 for discharging consecutive sheets, or prints, to the print tray 30.

The basic image forming operation of the color printer 100 will be briefly described hereinafter. While the drum 1 of the image forming unit 10 is caused to rotate clockwise, as viewed in FIG. 2, by drive means, not shown, the charger 2 uniformly charges the surface of the drum 1 to preselected polarity. Subsequently, the optical writing unit 14 scans the thus charged surface of the drum 1 with a laser beam modulated in accordance with image data of particular color, i.e., magenta, cyan, yellow or black, electrostatically forming a latent image on the drum 1. Each developing unit 3 deposits toner of respective color on the latent image thus formed on the associated drum 1 to thereby form a corresponding toner image.

While the intermediate image transfer belt 11 is driven to turn counterclockwise, as viewed in FIG. 1, toner images of different colors formed on the drums 1 of the image forming units 10 are sequentially transferred to the intermediate image transfer belt 12 one above the other, completing a full-color toner image on the belt 12.

Of course, only one or two or three of the four image forming units 10 may be used to form a monocolor image or a bicolor or a tricolor image, respectively. To produce a monochromatic print, only the Bk image forming unit 10 located at the rightmost position in FIG. 1 is used.

On the other hand, a sheet is paid out from the sheet cassette 15 and conveyed by the registration roller pair 18 toward the secondary image transfer section in synchronism with the full-color toner image carried on the intermediate image transfer belt 11. In the illustrative embodiment, an image transfer voltage opposite in polarity to the toner deposited on the intermediate image transfer belt 11 is applied to the image transfer roller 19, causing the full-color toner image to be transferred from the belt 11 to the sheet at a time.

The sheet, thus carrying the toner image thereon, is conveyed via the fixing unit 20 while having the toner image fixed by heat and pressure and is then driven out of the printer body to the print tray 30.

The configuration of each image forming unit 10 will be described more specifically with reference to FIG. 2. In the illustrative embodiment, the developing device 3, included in the image forming unit 10, is of the type having a developing device body and a toner hopper constructed integrally with each other. As shown in FIG. 2, the developing device 3 includes a developing roller 31, a toner supply roller 32, a doctor blade 33, an agitator 34, a fresh toner storing portion 35 and a waste toner storing portion 36. The fresh toner storing portion 35 is adapted for storing fresh, magenta, cyan, yellow or black toner which is fine colored powder. The waste toner storing portion 36 is adapted for storing waste toner conveyed thereto by a toner conveying belt 50. The fresh toner storing portion 35 and waste toner storing portion 36 are separated from each other by a partition member 37.

The cleaning device 4 includes a cleaning blade 4*a* configured to scrape off the toner left on the drum 1 and a conveying screw 4*b* configured to convey the toner thus collected in the casing of the cleaning device by the cleaning blade 4*a* in the axial direction of the drum 1, i.e., in the direction perpendicular to the sheet surface of FIG. 2.

The toner conveying belt 50, connecting the cleaning device 4 to the waste toner storing portion 36 of the developing device 3, is positioned at the rear side of the image forming unit 10, as viewed in FIG. 2, and indicated by a dash-and-dot line in FIG. 2. The toner conveying belt 50 is passed over pulleys 51 and 52. The conveying screw 4*b* of the cleaning device 4 is adapted to convey the toner scraped off from the drum 1, i.e., waste toner from the front toward the rear in the direction perpendicular to the sheet surface of FIG. 2, so that the toner conveying belt 50 can convey the waste toner to the waste toner storing portion 36. As the toner in the fresh toner storing portion 35 is consumed while the amount of waste toner introduced into the waste toner storing portion 36 increases, the partition member 37 is deformed in such a manner as to increase the capacity of the waste toner storing portion 36.

Figure 3:
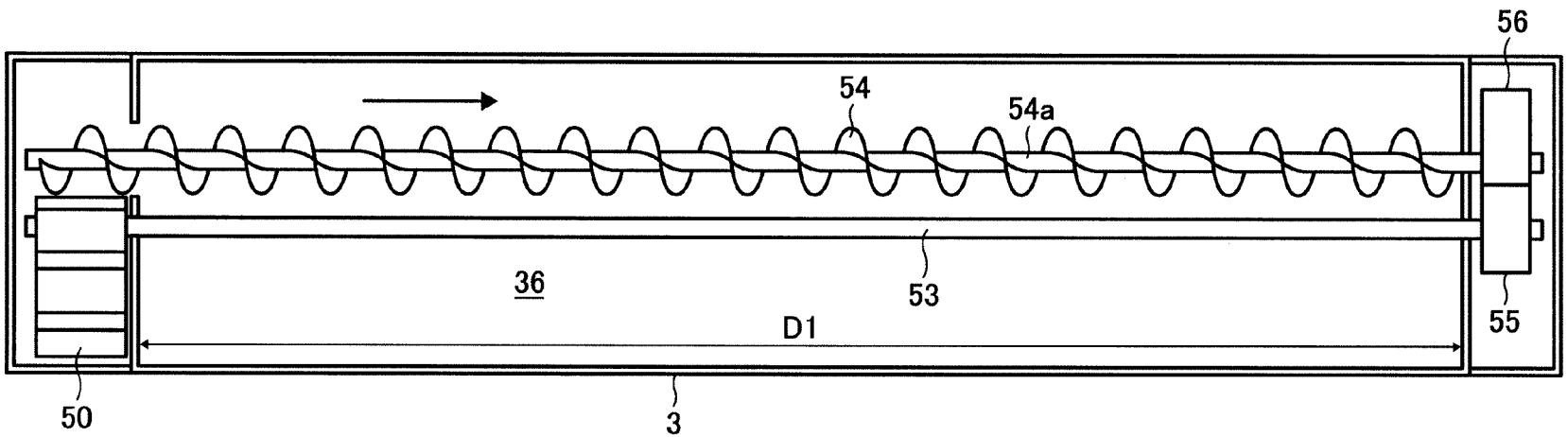
FIG. 3 is a horizontal section showing a waste toner collecting portion included in a toner collecting mechanism arranged in a developing device, which is also included in the illustrative embodiment.

FIG. 3 shows the configuration of the waste toner storing portion 36 included in the toner collecting mechanism of the developing device 3 in detail. In FIG. 2, the right-hand side and left-hand side are respectively a body drive side where a body driveline is arranged and a counter-drive side. FIG. 2 is a vertical section as seen from the right-hand side of FIG. 3; the toner conveying belt 50 is positioned at the rear side of the image forming unit in FIG. 2.

As shown in FIG. 3, a shaft 53 extends throughout the waste toner storing portion 36 from the body drive side to the counter drive side in the lengthwise direction of the developing device 3. The pulley 51, FIG. 2, over which the belt 50 is passed is affixed to one end of the shaft 53 while a drive input gear 55 is affixed to the other end of the shaft 53 remote from the pulley 51. The drive input gear 55 is held in mesh with a gear included in the body driveline, not shown, and causes the toner conveying belt 50 to turn via the shaft 53 and pulley 51 when driven to rotate.

A toner scattering screw 54, shown at the lower right of the toner conveying belt 50 in FIG. 2, has a shaft 54*a* extending, like the shaft 53, throughout the waste toner storing portion 36 from the body drive side to the counter drive side in the lengthwise direction of the developing device 3. A driven gear 56, affixed to the end of the shaft 54*a* adjoining the body drive side, is held in mesh with the drive input gear 55 mentioned previously, causing the toner scattering screw 54 to rotate when driven by the body drive side. In this configuration, the waste toner conveyed from the cleaning device 4 by the toner conveying belt 50 is dropped from the belt 50 to the toner scattering screw 54 at the counter drive side and then conveyed by the screw 54 to the right, as indicated by an arrow in FIG. 3, while being scattered. This allows the waste toner storing portion 36 to be filled with waste toner by effectively using the storing portion.

Figure 4:
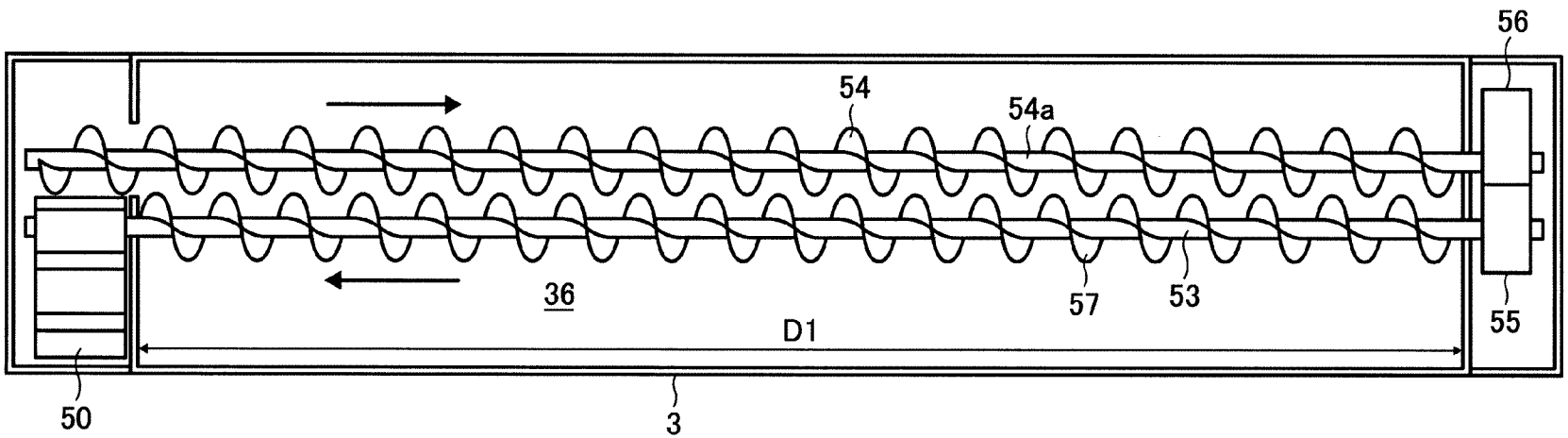
FIG. 4 is a view similar to FIG. 3, showing another specific configuration of the toner collecting mechanism.

FIG. 4 shows another specific configuration of the toner collecting mechanism. As shown, the toner collecting mechanism is identical with the toner collecting mechanism of FIG. 3 except that it includes a toner scattering screw 57 as waste toner scattering means. In FIG. 4, the shaft 53 for driving the pulley 51, FIG. 2, over which the toner conveying belt 50 is passed is implemented as the shaft of the toner scattering screw 57. The drive input gear 55 mounted on the shaft 53 and the driven gear 56 mounted on the shaft 54*a* are held in mesh with each other, so that the shafts 53 and 54*a* are rotated in opposite directions to each other. Consequently, the toner scattering screws 54 and 57 convey waste toner in opposite directions to each other.

In the configuration shown in FIG. 4, the waste toner conveyed from the cleaning device 4 by the toner conveying belt 50 is dropped from the belt 50 to the toner scattering screw 54 at the counter drive side and then conveyed to the right by the screw 54. Subsequently, the waste toner is conveyed to the left in FIG. 4 by the toner scattering screw 57, causing the waste toner to be circulated in the waste toner storing portion 36. This successfully prevents the waste toner from staying in the waste toner storing portion 36 and allows the waste toner storing portion 36 to be filled with waste toner by effectively using the storing portion.

In the toner collecting mechanisms described above with reference to FIGS. 3 and 4, the driveline for driving the toner conveying belt 50 and toner scattering screw 54 (57), i.e., the gear train 55 and 56 in the illustrative embodiment is arranged at only one side in the widthwise direction of the printer body, so that the width of the printer body can be minimized. Further, because the gear train is located at only one side, a minimum number of gears suffice. This reduces the number of parts constituting the printer, simplifies the assembly of the printer and reduces the accumulation of drive transmission losses.

Figure 5:
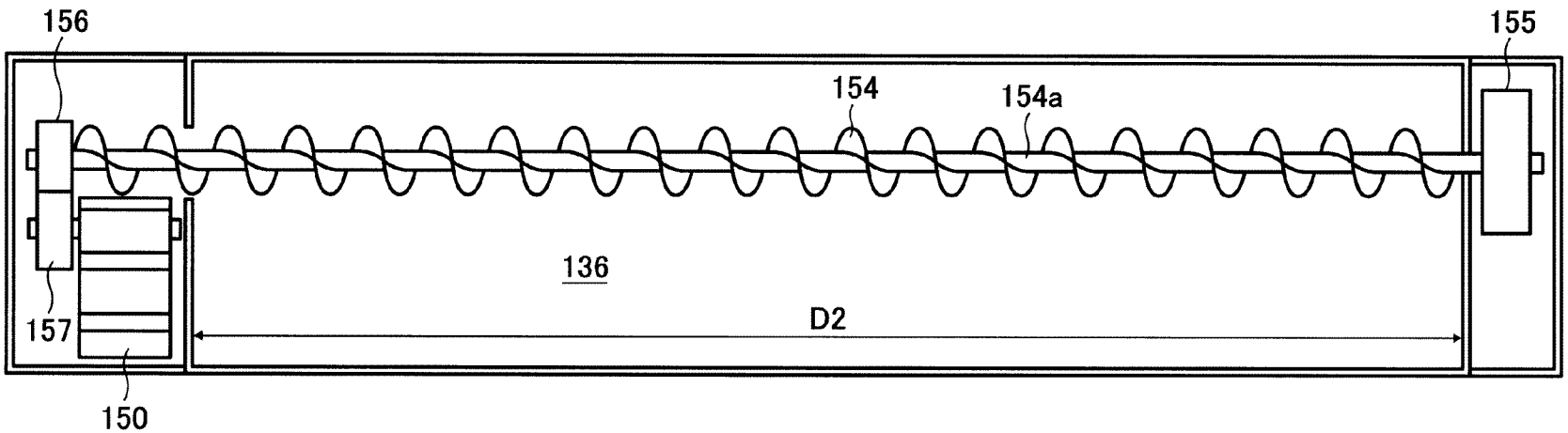
FIG. 5 PRIOR ART
FIG. 5 is a horizontal section showing a conventional toner collecting mechanism.

FIG. 5 shows a specific conventional toner collecting mechanism including a waste toner storing portion 136. As shown, a toner scattering screw 154 has a shaft 154*a*. A drive input gear 155 is mounted on the right end, as viewed in FIG. 5, of the shaft 154*a* adjoining a driveline included in an apparatus body, so that torque is transferred from the above driveline to the drive input gear 155. A gear 156 is mounted on the other end of the shaft 154*a* remote from the drive input gear 155 and held in mesh with a gear 157. A pulley, not shown, is mounted coaxially with the gear 157 in order to cause a toner conveying belt 150 to turn.

The problem with the conventional toner collecting mechanism described above is that the gear train or similar driveline for driving the toner conveying belt 150 is positioned at the counter drive side opposite to the body drive side and therefore needs an exclusive space at the counter drive side. It follows that assuming that the waste toner storing portion, including the driveline, has the same width, the width D2 of the storing portion available for actually storing waste toner is smaller than the width D1 of the storing portion of the illustrative embodiment, D1>D2. Stated another way, for a given printer width, the amount of waste toner that can be stored in the conventional storing portion decreases; the amount of waste toner that can be stored cannot be increased without increasing the printer width.

By contrast, the illustrative embodiment, which is configured to directly drive the toner conveying belt 50 from the body drive side, makes it unnecessary to provide a gear train or similar driveline at the counter drive side and therefore, for a given printer width, increases the amount of waste toner that can be stored.

A toner conveying screw or a toner conveying coil, e.g., the screw 4*b*, FIG. 2, included in a cleaning device assigned to a photoconductive body may be configured to be freely bendable to a certain degree so as to convey collected toner or waste toner to a waste toner collecting portion. This, however, brings about a problem that noise is generated by a duct or pipe and the screw or the coil disposed in and sliding on the wall of the duct or that the screw or the coil is damaged due to fatigue. The toner collecting mechanism of the illustrative embodiment is free from such problems.

If desired, the belt included in the illustrative embodiment as waste toner conveying means for conveying waste toner collected by the drum cleaning means to the waste toner storing portion may be replaced with a screw, auger or similar conveying means or a conveying coil or similar conveying means.

While in the illustrative embodiment the waste toner storing portion is constructed integrally with the developing unit, it may be provided independently of the developing unit or the toner hopper.

An arrangement may be made such that waste toner is collected from the intermediate image transfer body or the conveying belt instead of from the photoconductive body. The photoconductive body, intermediate image transfer body or similar image carrier may be implemented as a belt in place of a drum.

Further, the drive mechanism assigned to the conveying belt or similar waste toner conveying means and conveying screw or similar toner scattering means may be implemented by any other suitable drive mechanism, i.e., pulleys instead of the gear train shown and described. When use is made of gears, any suitable gears other than spur gears are usable.

The configuration of the cleaning device and that of the developing device shown and described are only illustrative. For example, the developing device may use either one of a single-component type and a two-component type developer, as desired. Also, each developing device and process cartridge including it may be provided with any suitable configuration. This is also true with the various sections constituting the image forming apparatus. The printer may, of course, be replaced with, e.g., a copier or a multifunction machine having a plurality of different functions.

In summary, it will be seen that the present invention provides a toner collecting device, an image forming unit and an image forming apparatus having various unprecedented advantages, as enumerated below.

(1) In the toner collecting device, a driveline for driving toner conveying means is not arranged at the side opposite to the driveline of the apparatus body, but the toner conveying means is directly driven by the driveline of the apparatus body, successfully minimizing the width of the apparatus body. In addition, because the driveline is arranged at only one side, the number of parts including gears and therefore the cots is reduced while the assembly is simplified and the accumulation of drive transfer losses is reduced.

(2) Because the toner conveying means is implemented as a belt, an arrangement for supporting and driving it and therefore the entire apparatus is simplified in construction.

(3) Waste toner scattering means allows a waste toner storing portion to be filled with waste toner by effectively using the waste toner storing portion.

(4) Second waste toner scattering means, configured to scatter waste toner in the opposite direction to the above waste toner scattering means, allows waste toner to be circulated in the waste toner storing portion. This prevents waste toner from staying in the toner storing portion and allows the waste toner storing portion to be filled with waste toner by more effectively using the waste toner storing portion. Further, the second waste toner scattering means is implemented as a drive shaft for driving the toner conveying means, so that the number of parts is reduced.

(5) The waste toner scattering means or the second waste toner scattering means is implemented as a toner conveying screw and can therefore surely convey and scatter waste toner in the waste toner storing portion.

(6) Waste toner removed from an image carrier by a cleaning unit can be collected by the toner collecting device. In addition, the width of the image forming unit can be reduced.

(7) The waste toner storing portion is arranged in the developing device, simplifying the configuration of the image forming unit.

(8) The waste toner storing portion is separated from a fresh toner storing space in the developing unit by a deformable partition member, so that a limited space available in the developing device can be effectively used for storing waste toner.

(9) The toner collecting device, which is simple in configuration and small size, reduces the overall width or the overall depth, i.e., the overall size of the image forming apparatus.

Various modifications will become possible for those skilled in the art after receiving the teachings of the present disclosure without departing from the scope thereof.

What is claimed is:

1. A toner collecting device for conveying collected waste toner to a waste toner storing portion, comprising:

a toner conveying means, said toner conveying means is positioned at a side opposite to a driveline included in an apparatus body to which said toner collecting device is mounted, said toner conveying means being directly driven by said driveline of said apparatus body;

a first waste toner scattering means configured to scatter the waste toner in said toner storing portion, the waste toner being conveyed to said waste toner storing portion by said toner conveying means; and a second waste toner scattering means configured to scatter the waste toner in a direction opposite to said first waste toner scattering means, and said second waste toner scattering means is configured as a drive shaft for driving said toner conveying means, wherein a driveline for driving said toner conveying means is not arranged at said side opposite to said driveline of said apparatus body.

2. The device as claimed in claim 1, wherein said toner conveying means comprises a conveying belt.

3. The device as claimed in claim 1, wherein one of said first and second waste toner scattering means includes a toner conveying screw.

4. An image forming unit comprising:

an image carrier;

a cleaning device configured to remove toner left on said image carrier;

a toner collecting device configured to convey waste toner removed from said image carrier by said cleaning device to a waste toner storing portion with a toner conveying means for thereby collecting said waste toner;

a first waste toner scattering means configured to scatter the waste toner in said toner storing portion, the waste toner being conveyed to said waste toner storing portion by said toner conveying means; and a second waste toner scattering means configured to scatter the waste toner in a direction opposite to said first waste toner scattering means, and said second waste toner scattering means is configured as a drive shaft for driving said toner conveying means, wherein said toner conveying means is positioned at a side opposite to a driveline included in an apparatus body to which said toner collecting device is mounted, the toner conveying means being directly driven by said driveline of said apparatus body, and wherein a driveline for driving said toner conveying means is not arranged at said side opposite to said driveline of said apparatus body.

5. The unit as claimed in claim 4, wherein said waste toner storing portion is disposed in said developing device.

6. The unit as claimed in claim 5, wherein said waste toner storing portion is separated from a fresh toner storing space by a deformable partition member.

7. An image forming apparatus comprising:

an image forming unit including an image carrier and a cleaning device configured to remove toner left on said image carrier;

a toner collecting device configured to convey waste toner removed from said image carrier by said cleaning device to a waste toner storing portion with a toner conveying means for thereby collecting said waste toner;

a first waste toner scattering means configured to scatter the waste toner in said toner storing portion, the waste toner being conveyed to said waste toner storing portion by said toner conveying means; and a second waste toner scattering means configured to scatter the waste toner in a direction opposite to said first waste toner scattering means, and said second waste toner scattering means is configured as a drive shaft for driving said toner conveying means, wherein said toner conveying means is positioned at a side opposite to a driveline included in an apparatus body to which said toner collecting device is mounted, the toner conveying means being directly driven by said driveline of said apparatus body, and wherein a driveline for driving said toner conveying means is not arranged at said side opposite to said driveline of said apparatus body.

* * * * *